United States Patent [19]

Rymoen

[11] Patent Number: 4,972,955

[45] Date of Patent: Nov. 27, 1990

[54] DEVICE IN CONNECTION WITH A BOX FOR CUTLERY

[76] Inventor: Kjell O. Rymoen, Blomsterveiene 24, N-2200 Kongsvinger, Norway

[21] Appl. No.: 501,108

[22] Filed: Mar. 29, 1990

[30] Foreign Application Priority Data

Dec. 5, 1989 [NO] Norway ..... 894857

[51] Int. Cl.[5] ..... B65D 85/20; B65D 8/00

[52] U.S. Cl. ..... 206/553; 134/84; 134/201; 220/485; 220/676; 220/213; 206/45.34

[58] Field of Search ..... 134/92, 84, 135, 201; 220/213, 84, 19; 206/553, 45.34

[56] References Cited

U.S. PATENT DOCUMENTS

| | | | |
|---|---|---|---|
| 514,488 | 2/1894 | Moore | 220/213 |
| 1,668,808 | 5/1928 | Griffin | 134/92 |
| 3,050,073 | 8/1962 | McMillah | 134/135 X |
| 3,935,958 | 2/1976 | Frangos | 134/84 X |
| 4,318,478 | 3/1982 | De Winter | 206/553 |

*Primary Examiner*—William I. Price

*Attorney, Agent, or Firm*—Browdy and Neimark

[57] ABSTRACT

A device in connection with a box for cutlery, in which bottom and side walls of the box are provided with perforations and/or slots. Said box is circular-cylindrical and across part of its curved portion it has an opening which may be closed by the aid of a curved closure means which is provided to be slidable inside said box.

3 Claims, 2 Drawing Sheets

DEVICE IN CONNECTION WITH A BOX FOR CUTLERY

The present invention relates to a device in connection with a box for cutlery, the bottom and side walls of said box being provided with perforations and/or slots.

Such boxes, among others, are known from common dishwashers for household use, and from dishwashers in hotel and restaurant business.

In hotel and restaurant business cutlery is generally washed in a two-step procedure. In a first step cutlery is placed on a large tray for washing, and in the second step it is provided in boxes. Upon completed washing the cutlery is placed in boxes close to a self-service location, from which customers can take pieces of cutlery. For household use, it is known to place cutlery in the cutlery tray of the dishwasher, if desired after preliminary washing by hand. Upon washing, cutlery is removed from the cutlery box by being held at the portion to be used for eating and is placed in a container for cutlery.

It is, thus, a common feature of the known devices that there is a hazard of other people than those who are to use the cutlery touching said cutlery if, after being washed, it is gripped by hand at the portion used for eating. In this case there is a hazard of bacteria being transferred to such cutlery, so that it is, in fact, no longer clean.

For a long time, there was thus a demand, especially in hotel and restaurant business where the hazard of infection is obviously more severe than in a family household, to ensure that cutlery is really clean until touched by the person using it to eat with.

To this end it is suggested to make said box circular-cylindrical and to let it have an opening across part of its curved portion which opening may be closed by the aid of a curved closure means which is provided to be slidable inside said box.

The box can, thus, serve as a storage box for cutlery in the dishwasher with said opening in this case being closed, and the box may then be removed from the dishwasher to be placed at a self-service location, said box then being provided with a removable but lockable cover. The curved closure means is in that case turned away, to provide said opening with a height and a width permitting a hand to be inserted to grip the handle of a desired piece of cutlery and remove it.

The invention will be disclosed in more detail below with reference to enclosed illustrations.

Figure 1:
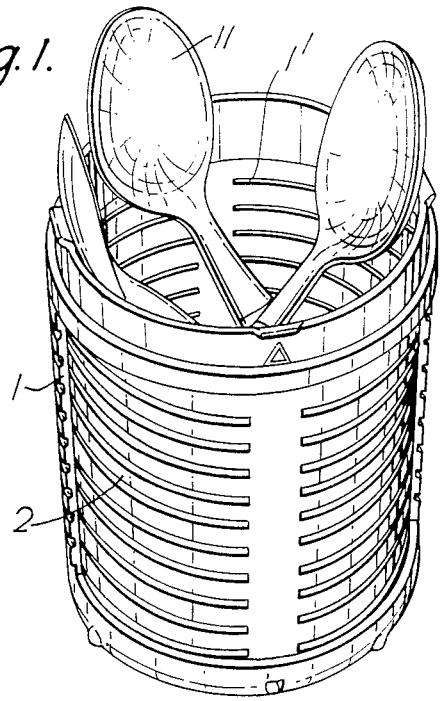
Figure 2:
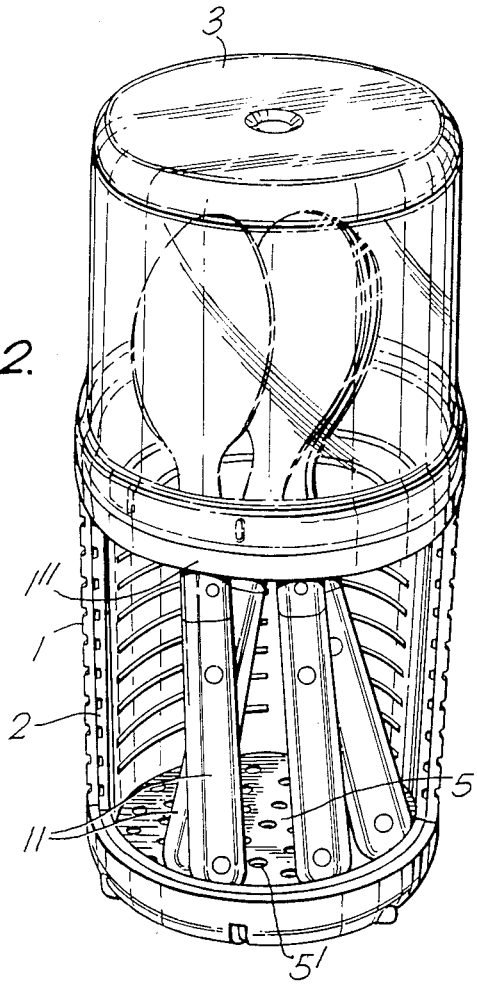
Figure 3:
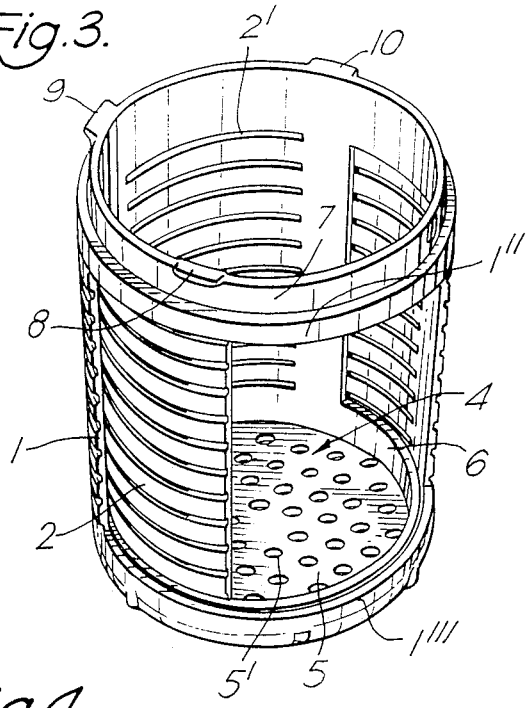
Figure 4:
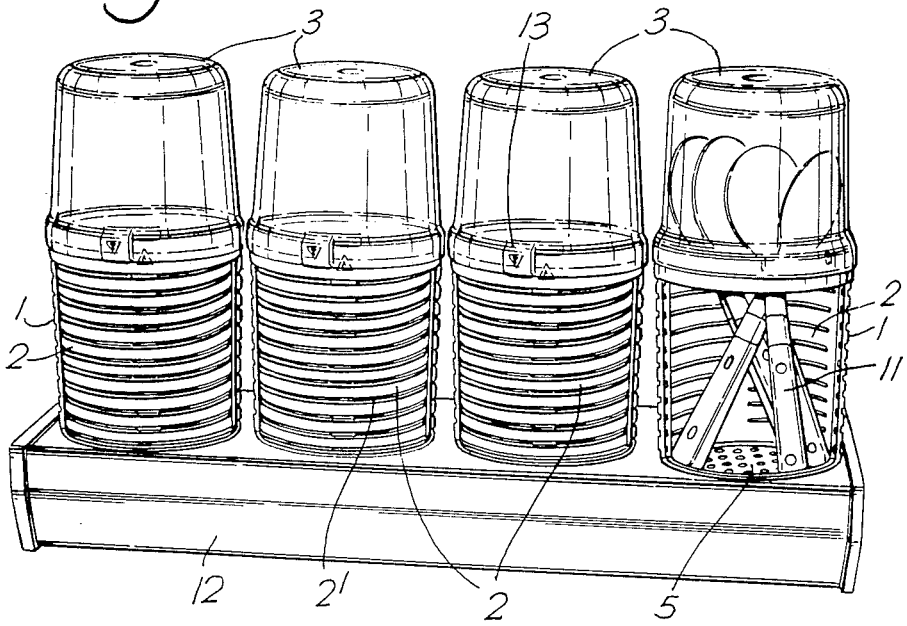

FIG. 1 illustrates a device in connection with a box for cutlery according to the invention, FIG. 2 shows the device of FIG. 1, provided with a removable and lockable cover, FIG. 3 illustrates the device of FIG. 1 with the curved closure means partly turned away to provide an access opening in the box, FIG. 4 illustrates the device according to the invention, as used in a stand for various kinds of cutlery.

In FIG. 1 a box of the mentioned kind is shown, with side walls of box 1 being provided with perforations 1', preferably in the shape of slots. Furthermore, bottom 5 of the box is provided with a number of perforations 5'. Basically, the box is circular-cylindrical and provided with an opening 4 across part of its curved portion, with opening 4 being limited by a residual portion 1'' of the side wall of the box. Lowermost, there is a corresponding edge 1''' rising from bottom 5 of the box.

Said opening may be closed by the aid of a curved closure means 2 which is slidable inside box 1. Said closure means, in fact, looks like the box, but it is slightly higher and lacks a bottom. Closure means 2 is, thus, provided with perforations 2', preferably in the shape of slots in its side wall portion. It is circular-cylindrical and has a smaller cross section than box 1, and across part of its side wall portion it has an opening corresponding to opening 4 of box 1, said opening being limited uppermost and lowermost by residual portions 7 and 6, respectively, of the side wall of said closure means. By the aid of the side walls of box 1 and portions 1'' and 1''', as well as the side wall and said portions 7, 6 of closure means a mutually slidable engagement is achieved, so that closure means may be turned freely, as desired, relative to box 1. Uppermost closure means 2 is provided with engaging lugs 8, 9, and 10 intended for cooperation with complementary members 13 on cover 3.

FIG. 4 illustrates how the device according to the present invention may be provided in recesses of a holder 12. If holder or stand 12 is designed so as to cause box 1 with cover 3 to slope slightly rearwards, lower edge portion 1''' of the box will prevent the box from canting out of the holder, since the box would then be caught by edge 1''' below the edge of the recess of holder 12.

In FIGS. 1, 2, and 4 the device according to the invention is shown with cutlery, in the shown embodiment with spoons. It will be obvious from FIGS. 2 and 4 that the only way to remove the cutlery is by gripping the handles, not the bowls used for eating. By the aid of the invention cutlery may, if desired, after preliminary washing, be placed in box 1 with closure means 2 in such a position that opening 4 is barred, as will appear from FIG. 1. Washing water may, thus, flow freely over the cutlery 11 from all sides and cause it to be efficiently washed.

Upon completed washing as mentioned, the cutlery with the cutlery holder is removed from the dishwasher and cover 3 is provided on cutlery box 1 in such a manner that its engagement means 13 engage with lugs 8, 9, and 10, respectively. When cover 3 is then turned slightly relative to closure means the cover is firmly locked to closure means and it is no longer possible to touch the portions of cutlery used for eating.

By the aid of the present invention a device is thus provided in connection with a box for cutlery serving both as a container for washing cutlery and as a storing and dispensing box for cutlery, with said device being arranged to permit cutlery to be handled in a hygienic manner from the moment it is removed from the dishwasher to the moment when it is to be used by a person for eating.

Having described my invention, I claim:

1. A device in connection with a box for cutlery, in which bottom and side walls of the box are provided with perforations and/or slots, characterized in that box is circular-cylindrical and has an opening across part of its curved portion, which opening may be closed by the aid of a curved closure means which is provided to be slidable inside said box.

2. A device as stated in claim 1, characterized in that a removable and lockable cover is provided on top of box.

3. A device as stated in claim 1, characterized in that said opening has a height and width permitting a hand to be inserted into opening to grip the handle of a piece of cutlery and to remove said piece of cutlery through said opening.

* * * * *